United States Patent [19]

Bordelon et al.

[11] 4,425,482

[45] Jan. 10, 1984

[54] RING ARMATURE ELECTROACOUSTIC TRANSDUCER

[75] Inventors: Chester M. Bordelon, Shreveport, La.; Richard M. Hunt, Indianapolis, Ind.; Robert A. Wheeler, Shreveport, La.

[73] Assignee: Western Electric Company, New York, N.Y.

[21] Appl. No.: 355,937

[22] Filed: Mar. 8, 1982

[51] Int. Cl.[3] ..... H04R 9/00

[52] U.S. Cl. ..... 179/120; 179/115 R; 179/117; 179/119 R; 335/231

[58] Field of Search ..... 179/120, 119 R, 115 R, 179/117; 335/231

[56] References Cited

U.S. PATENT DOCUMENTS

| | | | |
|---|---|---|---|
| 2,170,571 | 8/1939 | Mott | 179/119 R |
| 2,249,160 | 7/1941 | Mott | 179/120 |
| 2,506,609 | 5/1950 | Mott | 179/120 |
| 2,506,624 | 5/1950 | Wirsching | 179/120 |
| 2,520,640 | 8/1950 | Kreisel | 179/114 R |
| 2,520,646 | 8/1950 | Mott | 179/115 R |
| 2,566,849 | 9/1951 | Mott | 179/120 |
| 2,566,850 | 9/1951 | Mott . | |
| 2,567,365 | 9/1951 | Dalton . | |
| 4,075,437 | 2/1978 | Chin et al. | 179/114 R |
| 4,258,234 | 3/1981 | Bordelon et al. | 179/114 R |

OTHER PUBLICATIONS

*Permanent Magnets and Their Application;* by Parker et al.; Wiley 1962 pp. 153,154.

*The Ring Armature Telephone Receiver,* by Mott et al; Bell System Tech. Journal, vol. 50 Jan. 1951; pp. 110–140.

*Primary Examiner*—G. Z. Rubinson
*Assistant Examiner*—Danita R. Byrd
*Attorney, Agent, or Firm*—R. F. Kip, Jr.

[57] ABSTRACT

The disclosure relates to a ring armature electroacoustic transducer adapted for use as the receiver for telephone sets and for other purposes. The exemplary embodiment comprises the following elements coaxial about a common vertical axis: (a) a cylindrical ring permanent magnet (15) of Fe-Cr-Co material, (b) an annular disc upper pole piece (20) seated on magnet 15 and having at its inner margin a downwardly salient annular boss (30) providing an upper pole tip, (c) a lower pole piece (35) providing an annular lower pole tip (37) and aflange (36) coupling such tip (37) to the bottom of the magnet, (d) an armature support (40) within the magnet (15), (e) an annular disc armature (50) seated on the support (40), (f) a diaphragm (60) on the armature (50), and (g) a terminal plate (45) supporting such elements. The armature (50) is seated on a circular edge (90) on the support (40). The support (40), lower pole piece (35) and plate (45) form a unitary structure. The upper pole piece (20) has an external frustroconical bevel (25) at its outer margin.

11 Claims, 4 Drawing Figures

RING ARMATURE ELECTROACOUSTIC TRANSDUCER

FIELD OF THE INVENTION

This invention relates to electroacoustic transducers in which electrical signals are converted by a coil and an associated magnetic structure and diaphragm into sound vibrations or, conversely, sound vibrations are converted by such elements into electrical signals. More particularly, this invention relates to transducers of such kind which employ a "ring armature" and which are commonly used as the receiver of a telephone handset or headset, although they are also usable as the transmitter of such a set or for other purposes.

BACKGROUND OF THE INVENTION

A common kind of ring armature electroacoustic transducer comprises elements which are coaxial about a common vertical axis and which are (a) an annular permanent magnet, (b) a horizontal mechanically resilient armature in the form of a ring or annulus having its outer margin magnetically coupled to the magnet, (c) a lower pole piece with an annular upper end disposed below the inner margin of the armature to be spaced therefrom by a gap known as the "main gap", the pole piece providing a low reluctance magnetic flux path from such gap to part of such magnet displaced from its coupling with the armature, (d) a wire wound coil inductively coupled with such lower pole piece, and (e) a diaphragm mechanically coupled with the armature. The magnet in such a structure produces d.c. magnetic flux which can be considered as flowing from the magnet, radially inward through the ring armature, down through the lower pole piece to the bottom of the magnet and then up through the magnet to its place of beginning. When the transducer is used as a receiver, a.c. electric signal variations in the coil modify the d.c. flux to produce a.c. magnetic flux variations ("a.c. flux") which in turn cause the armature and coupled diaphragm to vibrate and generate sound vibrations corresponding to the signal variations.

In eary versions of such transducer as exemplified by that disclosed in U.S. Pat. No. 2,170,571 issued Aug. 22, 1939 in the name of E. E. Mott, the d.c. flux in the main gap below the inner margin of the armature is not complemented by any d.c. flux in a gap above that inner margin. That is, the magnetic circuit of such transducer is a single magnet, single gap circuit. Later, and as taught in Mott's U.S. Pat. No. 2,249,160 issued July 15, 1941, it was realized that a substantial increase in the "force factor" could be obtained if an auxiliary magnet were added to produce d.c. flux in such an upper or auxiliary gap, force factor being generally defined as the ratio of the mechanical force produced to the magnitude of the current producing it and, in this case, the "force" being that which actuates the diaphragm and the "current" being that which flows in the coil. According to an article, *The Ring Armature Telephone Receiver,* by Mott et al. in the Bell System Technical Journal, Vol. 50, January 1951, pages 110–140, the force factor is a function of the product of the d.c. flux and the a.c. flux.

For the purposes of providing d.c. flux in such auxiliary gap, the last named Mott patent discloses a transducer structure in which the permanent magnet heretofore referred to is in the form of a vertically elongated cylindrical ring magnetically coupled at its top or "N" end to the armature and its bottom or "S" end to the lower pole piece. Further, such "main" permanent magnet is supplemented by an auxiliary permanent magnet in the form of a horizontal annular disc ring disposed above the main magnet with its outer and inner margins being positioned, respectively, above the top of the main magnet, and above the inner margin of the armature to be spaced therefrom by an "auxiliary" gap, the auxiliary magnet being polarized "S" and "N" at, respectively, its outer and inner margins. With the progress of time and as exemplified by the transducer shown in, for example, U.S. Pat. No. 2,506,624 issued May 9, 1950 in the name of R. E. Wirching, the two permanent magnets were structurally combined into a single magnet by eliminating the spacing between them and making them integral with each other, but that structural change had no effect on the magnetic circuit of the transducer for which, magnetically speaking, there is still a main magnet section and an auxiliary magnet section in, respectively, one and the other of the two flux loops of the circuit which pass through the armature. Thus, whether such two loops respectively include two separate magnets or two different sections of a structurally single magnetized element, such circuit is, in a magnetic sense, a dual magnet, dual gap circuit.

As taught in Mott U.S. Pat. No. 2,249,160 and in more detail in the mentioned Mott et al. article, in a ring armature transducer of the sort described with a dual magnet, dual gap magnetic circuit, the radial flow of d.c. flux in the armature from the auxiliary magnet is opposite to that of the d.c. flux from the main magnet, and, by proper selection of magnetic conditions, there can be obtained a full flux balance for which the d.c. flux values in the main and auxiliary gaps are the same, and the oppositely flowing d.c. fluxes in the armature cancel out to yield in theory the advantages of maximizing the force factor and maximizing the dynamic permeability of the armature to thereby minimize its reluctance to a.c. flux. In practice, however, it is not possible to utilize such a full balance because of another consideration, namely that, in order for the armature to have adequate positional stability, it has to be biased downward by magnetic attractive force. Hence, to obtain such magnetic bias while still realizing as much as possible the benefits of magnetic balancing of the d.c. flux, it was settled upon to provide a weaker magnetic field in the auxiliary gap than in the main gap such that a 25% to 50% imbalance exists between the respective fluxes in those two gaps.

Recapitulating now the differences between the single magnet single gap circuit of Mott's '571 patent and the dual magnet dual gap circuit of his '160 patent, the single gap circuit of the former patent had 100% imbalance of d.c. fluxes to thus be better than necessary in providing positional stability of the armature. Because, however, of the absence of the extra magnetomotive force ("MMF") from an auxiliary magnet and the fact that the d.c. flux in the armature was equal to the full d.c. flux in the circuit to thereby bias the armature at a point on its saturation curve yielding high dynamic reluctance of the armature to a.c. flux, the single gap circuit had a poor force factor compared to the later dual magnet dual gap circuit of the Mott '160 patent.

As an alternative to both such circuits, Mott proposed in a single paragraph in his U.S. Pat. No. 2,566,849, issued Sept. 4, 1951, a ring armature transducer with a single magnet double gap circuit arrived at, in essence, by adding to his previous single magnet single gap circuit an unpolarized magnetic annular disc member of, say, "Permalloy" disposed over the ring armature such that the outer margins of the armature and member were magnetically coupled and the inner margins thereof were separated by an auxiliary gap complementing the main gap between the armature and lower pole piece. In a magnetic sense, that disc member added to the single magnet single gap circuit a magnetic shunt for the flux path through the armature. The effect of the shunt was to render the reluctance between the magnet and the main gap the combined reluctance of two parallel branches consisting of (1) the armature and (2) the unpolarized disc member and the auxiliary gap in series. Such combined reluctance would of course be lower than that of the armature alone to thereby produce the effects of an increase in the d.c. flux through the main gap, and of a splitting of the d.c. flux flowing from the magnet to the main gap into separate fractions carried by the member and armature, the fraction of such flux flowing through the armature being less than the d.c. flux it would carry if such magnetic shunt were not present. Because, however, the shunt flux path paralleling that of the armature included not only the relatively low reluctance of the disc member but also the high reluctance of the auxiliary gap, the mentioned effects would be relatively small in magnitude. Thus, as compared to the single magnet single gap circuit of the Mott '571 patent, the single magnet double gap circuit proposed in Mott's '849 patent would in theory be only a minor improvement and, as compared to the double magnet double gap circuit disclosed in the Mott '160 patent, the proposed circuit would in theory and in an overall sense be retrogressive in that while providing a flux imbalance likely more than necessary to assure adequate stability of the armature, it would, due to the absence of an auxiliary magnet, and due also to the relatively high level of d.c. flux through the armature (leading to its high dynamic reluctance to a.c. flux), have a substantially poorer force factor than a comparable double magnet double gap circuit.

Perhaps, for the reasons stated above, ring armature transducers having a single magnet double gap circuit of the sort proposed in the Mott '849 patent have never, insofar as we know, been put to practical use. Instead, the double magnet double gap design for the magnetic circuit has been the one popularly selected for ring armature transducers as exemplified, for example, by the transducers disclosed in U.S. Pat. No. 4,075,437 issued Feb. 21, 1978 in the name of Chin et al., U.S. Pat. No. 4,258,234 issued Mar. 24, 1981 in the name of Bordelon et al., and U.S. Patent Application Ser. No. 262,602 filed May 11, 1981 in the name of Bordelon et al., and assigned to the assignee hereof, such two last named patents and such patent application being incorporated herein by reference.

Until recently, the permanent magnetic material used in ring armature transducers has been either the aluminum-nickel cobalt alloy known commercially as Alnico or the molybdenum-cobalt iron alloy known commercially as Remalloy. Within the past few years, however, there has been developed a family of Fe-Co-Cr magnetic alloys which are known commercially as Chromindur alloys and which are disclosed, for example, in the mentioned patents to Chin et al. and to Bordelon et al. Chromindur alloys have been employed in lieu of Alnico or Remalloy to provide, as taught by those patents, the permanent magnets utilized in ring armature electroacoustic transducers. The representative embodiments of transducers disclosed by these patents have, however, dual magnet dual gap magnetic circuits which, as stated, have in the past offered overall more advantages in practical use than have other types of magnetic circuits.

There has developed, however, a problem in the extensive use of Chromindur alloys in transducers of the ring armature type. Specifically, the cobalt and chromiun constituents of the alloy, have become very expensive. Moreover, both chromium and cobalt are in limited supply so as to render incertain the degree to which those metals will be available in the future.

Accordingly, it would clearly be desirable to provide ring armature electroacoustic transducers which, while taking advantage of the superior magnetic qualities of Chromindur alloys, use less of it disclosed in the mentioned Chin et al. and Bordelon et al. patents, and which, at the same time, perform from the magnetic circuit viewpoint in a manner which is fully adequate to meet commercial needs.

SUMMARY OF THE INVENTION

In accordance with an aspect of the invention, there is provided a ring armature electroacoustic transducer which employs a permanent magnet comprising a Chromindur alloy and which, to conserve the amount of such alloy used, has a single magnet double gap magnetic circuit, but which, due to improved geometry and mode of construction, has a performance capability fully acceptable for commercial use and comparable to the ring armature transducers having double magnet double gap magnetic circuits which are now commercially used. Such transducer comprises elements which are coaxial about a common vertical axis and which are: a cylindrical ring magnet comprising such alloy, an upper pole piece in the form of an annular disc seated at its outer margin on such magnet in flat abutting relation therewith, a lower pole piece, of "L" cross section to one side of said vertical axis in planes therethrough, so as to comprise an upstanding portion providing a lower pole tip and a radially salient flange portion magnetically coupling such lower tip to the bottom of said magnet, a synthetic resinous armature support disposed with a close fit inside said magnet and having a top below that of said magnet but above said lower tip, a coil inductively coupled with the lower pole piece, a mechanically resilient armature in the form of a thin annular disc having its outer margin seated on such support and its inner margin interposed between the upper pole piece and the lower pole tip, the armature having to one side of such axis in planes therethrough a thin elongated rectangular cross section with a radially inward downward slant, and an acoustic diaphragm mounted on the armature. By virtue of utilizing a permanent magnet comprising Chromindur alloy and, also, the geometry and mode of construction just described, a transducer according to the invention can be manufactured at substantially less cost than ring armature transducers now commercially used while performing substantially as well or better than such commercial transducers.

The character of the invention in other of its aspects will become evident by further reading of the text hereof.

BRIEF DESCRIPTION OF DRAWINGS

For a better understanding of the invention, reference is made to the following description of a representative embodiment thereof and to the accompanying drawings wherein.

Figure 1:
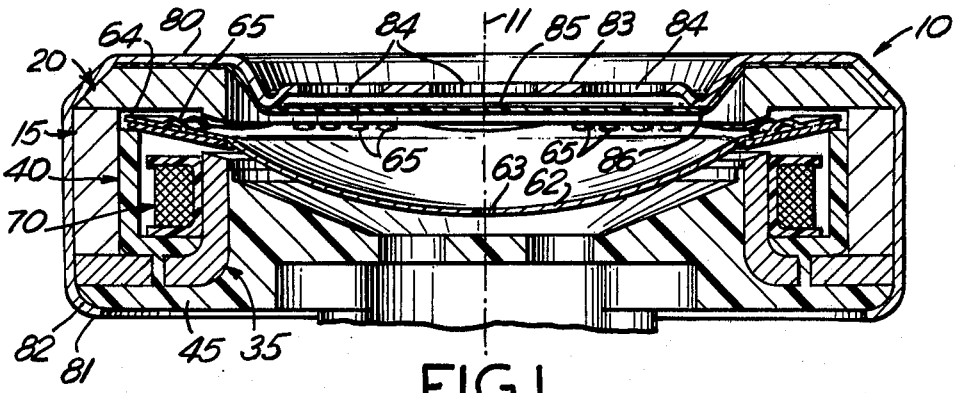
FIG. 1 is a front elevation in cross section of an exemplary ring armature electroacoustic transducer according to the invention, the FIGURE not being to scale, and features thereof being exaggerated in its vertical dimensioning relative to its horizontal dimensioning.
Figure 2:
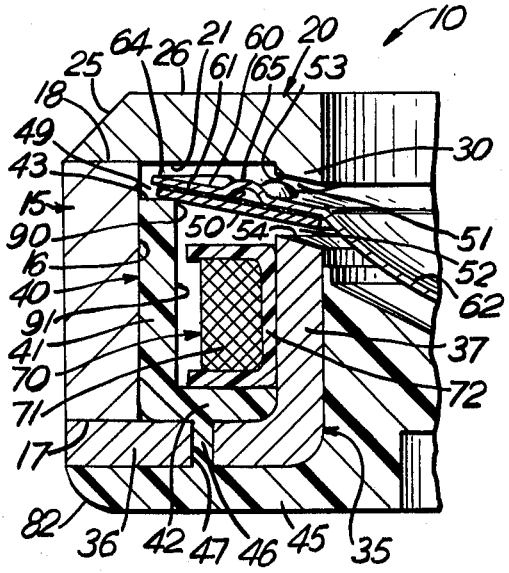
FIG. 2 is an enlarged view in front elevation and cross section of the left-hand portion of the FIG. 1 transducer, such view again not being to scale, and features thereof being exaggerated in its vertical dimensioning in relation to its horizontal dimensioning.

As shown by FIGS. 1 and 2 and as described herein the exemplary transducer has a particular orientation in space. It is to be understood, however, that notwithstanding how described or claimed, the invention is not limited to any particular spatial orientation.

DESCRIPTION OF EMBODIMENT

Referring now to the FIGURES, the reference numeral 10 generally designates an exemplary ring armature electroacoustic transducer according to the invention which is constituted of elements which, except as may be otherwise noted herein, are coaxial about a common vertical axis 11. The transducer 10 is adapted to be fitted into a matching receptacle in the housing (not shown) of a telephone handset or telephone headset to provide the receiver of such set.

Transducer 10 includes a permanent magnet 15 in the form of a circular cylindrical ring having a circular cylindrical inner vertical wall 16 and lower and upper annular horizontally planar end faces 17 and 18 which are ground flat.

The permanent magnet 15 consists essentially of a Chromindur alloy of a composition which is in accordance with the disclosure in the mentioned U.S. Pat. No. 4,258,234 issued Mar. 24, 1981 to Bordelon et al. of alloys for use as permanent magnet material of a ring armature transducer. For the purposes hereof, the material of such magnet can be properly described as comprising an alloy at least 90% by weight of which consists of Fe, Cr and Co, with the Cr and the Co being present in such 90% amount in the respective ranges of 20–40 weight percent of such amount for the Cr and 3–30 weight percent of such amount for the Co. The material of magnet 15 is preferably (but not necessarily) magnetically anisotropic to thereby reduce the cost of the magnet by about 10% as compared to what it would be if its Chromindur material were to be magnetically isotropic. In relation to the magnetic circuit of transducer 10, the magnet 15 is essentially entirely a "main" magnet or, to put it another way, there is no significant section of magnet 15 along its length which acts as an auxiliary magnet. Accordingly, the magnetic circuit of transducer 10 is a single magnet double gap circuit.

Permanent magnets of Chromindur have a cost which, to begin with, is, on a per unit volume basis, only half that of structurally similar permanent magnets of Remalloy or Alnico. Moreover, the elimination of the permanent magnet material of the auxiliary magnet obtained in transducer 10 by using a single magnet double gap magnetic circuit works further cost saving in relation to transducers employing double magnet double gap magnetic circuits. Because of both of those considerations, the cost of manufacturing transducer 10 can, primarily on the basis of the character and amount of permanent magnet material used therein, be reduced 30% to 50% from the cost of comparable transducers now in commercial use and employing Alnico or Remalloy permanent magnets in double magnet double gap magnetic circuits, as, for example, the U-3 ring armature transducer now in widespread commercial use in the Bell System. At the same time, the presently described transducer is capable of providing 10% greater energy product at the operating load line of the device than previously used commercial transducers employing Remalloy permanent magnets, as, for example, such U-3 receiver.

Returning to the structure of transducer 10, disposed over the magnet 15 is an upper pole piece 20 constituted of magnetically soft material and in the form of an annular disc with the same outer diameter as the magnet and with a horizontally planar underside 21 which is ground to be flat at at least its outer margin. As shown, the pole piece 20 is seated on the magnet's upper end face 18 with the outer margin of the undersurface 21 of the pole piece being in flat abutting relation with the end face 18 of the magnet over the entire area of that end face, and with such undersurface being normal to the inner cylindrical wall 16 of the magnet in planes through the vertical axis 11 of the transducer. Because the magnet's end face 18 and the portion in contact with it of the pole piece's underside 21 are both ground flat, the interface between those two surfaces is essentially gapless, i.e., there are no significant voids or discontinuities between those two surfaces which would tend to increase the reluctance of the magnetic path passing from one to the other of the magnet and pole piece.

The pole piece 20 has formed on its top and at its outer margin a frustroconical surface or "bevel" 25 extending radially outward and downward, at a 45° angle to axis 11 in planes therethrough, from the top 26 of the pole piece to a termination of surface 25 at the outer diameter of the pole piece and adjacent to its undersurface 21. We have found experimentally, although we have no ready explanation for it, that a bevel of such kind is advantageous to use in transducer 10 providing that the bevel's angle in relation to axis 11 is within the range extending from about 60° to about 40°. For angles made with axis 11 which are less than about 60°, no significant improvement in the performance of the transducer has been experimentally noted, and for angles with axis 11 less than 40°, our experimentation indicates that the performance of the transducer falls off in relation to its performance for angles within that range.

At its inner margin, the pole piece 20 includes as an integral part thereof an annular boss 30 projecting downward from such margin and in the form of a circular cylindrical stub ring having the same inner diameter as the pole piece. The boss 30 provides an upper pole tip for the magnetic circuit transducer 10. Of course, the sidewall of boss 30 need not conform to a cylinder but may be frustronconical or conform to any other surface of revolution about axis 11 which is at a lesser angle in the downward direction to said axis in planes therethrough than is the underside of pole piece 20 surrounding that boss.

That magnetic circuit also includes a lower pole piece 35 of magnetically soft material, and having to one side of axis 11 in planes therethrough, an "L" shaped cross section so as to consist of the parts, integral with each other, of a lower radially salient flange 36 of the same outer diameter as magnet 15 and an upper circular cylindrical stem portion 37 providing a lower pole tip in downwardly spaced relation from the upper pole tip 30. The outer margin of flange 36 is ground flat and lies beneath the magnet's ground bottom surface 17 in flat abutting relation therewith over the entire area of that surface to thereby provide a magnetic coupling of the lower pole tip 37 to the magnet.

Above the flange 36 of the lower pole piece is an annular armature support 40 of synthetic resinous material and of "L" cross section to one side of axis 11 in the planes therethrough. The support 40 includes, as integral parts thereof, an upper cylindrical sleeve 41 and a lower radially inturned flange 42 overlying the radially salient flange 36 of the lower pole piece 35. Sleeve 41 is disposed with a close fit inside the inner cylindrical wall 16 of magnet 15, and the sleeve has an upper annular horizontal planar end face 43 disposed vertically below the interface of magnet 15 and upper pole piece 20 but above the upper end of lower pole piece 35. The flange 42 of armature support 40 extends radially inward from the sleeve 41 to the bend between the portions 36 and 37 of the lower pole piece.

Lower pole piece 35 is contacted on its inner and lower sides with the material of a synthetic resinous terminal plate 45 providing a mounting for the elements beside itself of transducer 10. Plate 45 is constituted of the same synthetic resinous material as is support 40, and the plate is joined thereto by necks 46 of such material passing through a set of apertures 47 formed in flange 36 at locations spaced angularly around the flange, such apertures passing axially therethrough. By virtue of being so joined by those necks 46, support 40 and plate 45 are integral parts of the same synthetic resinous member within which the lower pole piece 35 is contained to be inseparable therefrom and fixedly positioned in relation thereto so as to form with such member a unitary structure. In practice, such unitary structure can be arrived at by plastically molding such member and by introducing the lower pole piece as an insert into the mold cavity prior to an injection of the plastic material thereinto.

The element 40 is the support for a mechanically resilient armature 50 of magnetically soft material and in the form of a thin annular ring having to one side of axis 11 in planes therethrough an elongated rectangular cross section with a downward slant in the radially inwardly direction. As shown, the armature is seated on the upper end of support 40 to be separated from the inner wall 16 of the magnet by an annular space providing a small radial gap 49 between that wall and the outer diameter of the armature. The inner margin of the armature is interposed between the upper and lower pole tips 30 and 37 to vertically divide the space between them into an upper or auxiliary gap 51 ana lower or main gap 52. Auxiliary gap 51 is bordered on its upper side by a frustroconical pole face 53 forming the lower end face of boss 30 and having a slant in planes through axis 11 substantially the same as the slant in such planes of the cross section of the portion of the armature which lies between the two pole tips. The main gap 52 is similarly bordered on its lower side by an annular frustroconical pole face 54 constituting the upper end face of pole tip 37 and having a slant corresponding to that of the adjacent portion of the armature.

The armature 50 has mounted thereon a light weight acoustic diaphragm 60 having a generally circular periphery and bonded at its outer rim by a layer 61 of commercial available gluing compound to substantially all of the annular upper surface of the armature. Inwards of the armature, the diaphragm 60 is downwardly dished (FIG. 1) to be in the form of a shallow dome 62 having at its center a single aperture 63 provided there for acoustic reasons. At its outer edge the diaphragm has a set of tabs 64 spaced around its periphery and projecting radially outward of that periphery and beyond the outer diameter of the armature. As taught in U.S. Pat. No. 2,520,640 issued on Aug. 29, 1950 in the name of R. R. Kriesel, tabs 64 are adapted to prevent the armature from inadvertently sticking to the inner wall 16 of the magnet 15.

As an additional anti-sticking element, diaphragm 60 has spaced annularly around it, above the radial midportion of the armature, a series of upward indentations formed in the diaphragm material by stamping or the like and providing convex dimples 65 on the upper surface of the diaphragm. Those dimples are adapted to prevent inadvertent holding of the armature-diaphragm assembly to the undersurface of the upper pole piece 20 in instances where that assembly has been brought into close proximity with such pole piece.

For purposes of actuating the transducer 10 by electrical signals, an electrical coil 70 consisting of an insulated wire winding 71 and a mandrel 72 supporting that winding encircles the cylindrical ring stem portion 37 of the lower pole piece 35 and is secured thereto by a gluing of the inner cylindrical surface of the base of the mandrel to the outer cylindrical surface of such stem portion. As shown, coil 70 is radially disposed between that stem portion and the upstanding sleeve 41 of the armature support 40.

The magnetic 15 and upper pole piece 20 are maintained in their shown assembled relation with elements 40, 35 and 20 by a synthetic resinous ferule 80 having a lower radially inturned curved resilient flange 81 which, when slipped over an annular convexly curved shoulder 82 on terminal plate 45, will, by bearing on that shoulder cause the upper outer margin of the ferule to press down on pole piece 20 so as to force magnet 15 downward, the magnet in turn pressing down on the radially outer margin of the flange 36 of the lower pole piece 35. As is conventional, the top ferule 80 has formed therein a shallow annular trough 86 from the inside of which there projects upward a raised central portion 83 having axial holes 84 therein to provide a ferule grid. A circular membrane 85 is stretched across the bottom of trough 86 to lie beneath the ferrule grid, the membrane serving to protect the elements of the transducer from dust passing through holes 84.

Some features of the transducer 10 will now be described in more detail.

In previous ring armature electroacoustic transducers as exemplified by the mentioned "U3" ring armature receiver, some pra have been to make the armature of 2V-vanadium permendur, to have the size of the main air gap between 0.002" and 0.005", and to provide for a size of the auxiliary gap (as measured vertically from the upper pole piece to the top surface of the diaphragm) of about 0.035" or greater or, in other words, well in excess of three times the size of the main gap. The aforementioned Mott et al. article discloses for the transducers described therein that the size of the auxiliary gap should be four to five times the size of the main gap.

In contrast to those practices of the prior art, we have found that the efficiency of the transducer can be increased by the use of one or more of the following features which are incorporated into transducer 10.

First, the armature of such transducer is rendered mechanically stiffer than a comparable one of 2V-vanadium Permendur by using a different material for the armature. Such material can be, for example, an iron-nickel alloy which is of a composition disclosed in the aforementioned patent application Ser. No. 262,602, and which can properly be described for the purposes hereof as being constituted as from six to twelve weight percent of nickel with the balance being iron. Other materials stiffer than 2V-vanadium Permendur can, however, also be used as the armature material.

Second, the size of the main gap is increased to be in the range from about 0.007" to about 0.010" (such size being measured along a vertical line extending from the bottom surface of the armature to the center of the lower pole piece) and, despite such increase which increases the reluctance of the transducer's magnetic circuit to d.c. and a.c. flux, the efficiency of the transducer has been found to be improved.

Third, the size of the auxiliary gap has been reduced to be in the range between about 0.015" and 0.020". In such a connection, the size of the auxiliary gap is measured on a vertical line extending from the upper pole face 53 to the center of the lower pole face 54, the size of the auxiliary gap itself being measured between the pole face 53 and the top surface of the diaphragm 60. We have found that, in general, the size of the auxiliary gap should be in the range from about 1 to about 3 times the size of the main gap. If the size of the auxiliary gap is less than that of the main gap, the armature during peak vibration will tend to strike the upper pole tip. If the auxiliary gap is more than three times that of the main gap, the motor efficiency of the transducer will tend to fall off.

The annular boss 30 on the upper pole piece 20 performs a particularly useful function in that the boss not only directly shortens the length of the auxiliary gap but, also, causes almost all of the flux in that upper pole piece which passes to the lower pole piece to flow exclusively through the pole face 53 on the boss so as to almost entirely eliminate the fringing effects which would occur if such boss were absent. That is, by minimizing such fringing effects, the boss 30 shortens, in effect, the virtual length of auxiliary gap 51 and, thereby, its reluctance. Also, by concentrating the flux in the upper pole piece so that it flows substantially entirely through the upper pole tip 30 and the upper hole face 53 in order to reach the lower pole piece, the boss 53 causes the flux lines in the auxiliary and main gaps 51 and 52 to be better collimated.

By virtue of the pole faces 53 and 54 being frustroconical faces with a slant the same as that as the portion of the armature in the space between them, the respective vertical lengths of the gaps 51 and 52 remain substantially uniform from point to point over the horizontal cross-sectional areas occupied by those gaps. Such uniformity is desirable because it avoids point-to-point variation in the density of the flux passing through such gaps and, concomitant saturation effects, varying from point to point over the gap areas, which would tend to lower the total amount of flux transversing those gaps.

Turning now to the seating of armature 50 on its support 40, due to the radial inward and downward slant of the armature in its vertical cross section, the armature rests inwards of its outer diameter on a pronounced circular "knife" edge 90 formed by the intersectin of the horizontal upper face of support 40 with its inner vertical cylindrical wall 91. When the armature is centered horizontally in relation to its support, edge 90 makes circular line contact with the underside of the armature. Should the armature move off center with an accompanying tendency to tilt slightly, the armature 50 will no longer contact edge 90 over its entire circle, but the geometry will be such as to tend to restore the armature to its centered untilted position as it continues to vibrate.

Of equal or more importance, however, is the fact that, with such knife edge mounting of the armature, the distance in any plane through axis 11 along any armature radius, between the contact point of the armature with support 40 and the intersection of that radius with the vertical line in that plane which is centered within the radial extents to one side of axis 11 of the main and auxiliary gaps 51 and 52 is a distance which will remain constant in value despite any shift of the center of the armature away from its true centered relation with support 40. It follows that, considering any such distance as the arm of a moment of which the force component is provided by the a.c. magnetic force acting in gaps 51 and 52 on the armature, such moment will, for all radii of the armature, remain constant for constant a.c. magnetic force despite any center shifting of the armature in relation to support 40 as the armature vibrates. From this, it follows in turn that, because of its described knife edge support, the response of the armature to the magnetic forces thereon will be rendered independent of any off center shifting of the armature under vibration, and such uniformity of response of the armature is of course advantageous.

Figure 3:
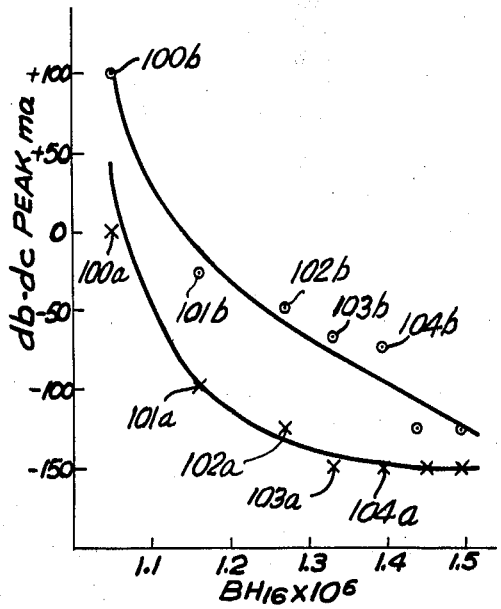
FIG. 3 is a graph showing certain characteristics of a ring armature transducer having in its magnetic circuit a bevel in accordance with an aspect of the invention as compared to characteristics of such a transducer devoid of such bevel.

With regard to the bevel 25 on the upper pole piece 20, FIG. 3 is a graph showing the effect on a ring armature transducer of having such a bevel as compared to a similar transducer lacking such bevel. The graph has therein various pairs of points 100*a*–100*b*, 101*a*–101*b* etc. of which the "a" points are indicated on the graph by an "X" and the "b" points by a circle with a dot in it. Each pair of "a" and "b" points correspond to a respective one of various permanent magnets for ring armature transducers, the BH energy product for each such magnet being represented by the horizontal displacement of the corresponding pair of points from the origin as shown on the horizontal ordinate line for the graph, and the numbers below that line being values of the shown expression "$BH_{16} \times 10^6$" where "B" is permeability in gauss, "H" is coercive force in oersteds, the subscript "16" indicates that the B/H ratio (i.e., permeance coefficient) of the transducer has a value of 16 for the measurements shown in FIG. 3, and "$10^6$" is a multiplying factor. For each such magnet, its associated "a" point (marked by an "X") was obtained when a bevel 25 at an angle of 45 degrees was used in the magnetic structure of the transducer, and its associated "b" point was obtained when no bevel was used.

In the graph, the vertical displacement (from the origin) of each point represents the amount of current in milliamperes which had to be used to produce the amount of flux which had to be added to or subtracted from the d.c. flux from the magnet associated with that point in order to produce peak sound level pressure output from the transducer in response to a standard 1000 Hz input signal to the transducer. Thus, for example, the graph shows that for the situation represented by point 100*a* (i.e., for a transducer with a 45 degree bevel 25 and a magnet having a BH energy product of about one million), it was not necessary to use any current changing the d.c. flux from the permanent magnet in order to produce such peak response, whereas for the situation represented by point 100*b* (i.e. for the same transducer with the same magnet but without such bevel), it was necessary to use 100 milliamps of d.c. current adding d.c. flux to the permanent magnet d.c. flux in order to attain such peak response.

The current referred to above does not permanently further magnetize the transducer or demagnetize it. It is relevant to that subject, nonetheless, in that what points 100*a* and 100*b* indicate is that, for the situation represented by point 100*a*, nothing further need be done to attain peak sound level pressure output but, for the situation represented by point 100*b*, the transducer should be provided with more d.c. flux on a permanent basis to achieve peak sound output than is afforded from the permanent magnet being used. To add, however, such further d.c. flux permanently without changing the magnet can't be done. On the other hand, it is always possible to reduce the d.c. flux from a permanent magnet by partially demagnetizing it.

The "a" and "b" points on the FIG. 3 graph show that when the transducer incorporates therein a bevel such as the bevel 25 of transducer 10, it is always possible, by appropriate demagnetizing of the permanent magnet to bring the permanent d.c. flux to a value at which the peak sound level pressure output of which the transducer is capable can be obtained, but, on the other hand, if the transducer has no such bevel, there will be cases (as exemplified by point 100*b*) where there is no practical way of achieving such peak output. Such cases can often arise from variations from nominal value in the energy product of a permanent magnet whose nominal energy product would never require addition of d.c. flux to achieve peak output. It follows that the use of such a bevel in the transducer provides the feature that the magnetic characteristics of the magnet and of the material from which it is made need not be controlled to be within such close tolerances from nominal value to obtain peak output as would be necessary if there were no such bevel. The lack of need for such control is advantageous in that it permits such transducer to be manufactured in large quantities at lesser cost per transducer. The advantage just described flowing from the use of such bevel is realizable not only in transducers having the geometry of the transducer 10 but also in other transducers of different geometry.

The portions of armature 50 and diaphragm 60 which are radially outward of the armature's contact with edge 90 are supported in cantilevered relation by the remainder of the armature and diaphragm structures so as to be raised above the end surface 43 of the support 40. Such cantilevered raising of the outward portion of the armature above such surface assures that the contact between the armature and its support will be the described line contact (instead of a contact over an area) whether the armature is on center or off-center in relation to the support. As shown, these centilevered annular portions of the armature and the diaphragm fit within the annular channel of the rectangular cross section (to one side of axis 11 in planes therethrough) which is bounded by the surface 43 of support 40, the inner wall 16 of magnet 13 and the undersurface 21 of upper pole piece 20. Since the radially outer surface of armature 50 is magnetically coupled in that channel, via radial gap 49, to the magnet and the pole piece without any intervening metallic elements, eddy current losses are reduced as compared to what they would be if such elements were present. Because the underside 21 of the upper pole piece 20 directly abuts the top of magnet 15 and is at right angles thereto, the vertical width of such channel can be controlled to be within close tolerances from nominal value such that, consonant with obtaining acceptable transducer performance, that width can be reduced to the point where the vertical or axial air gap between the mentioned underside of pole piece 20 and the nearest point on the diaphragm is less than is the main air gap 52, i.e., is less than about 0.007".

In general, the geometry of transducer 10 wherein pole piece 20 is separate from magnet 15 but directly abuts its top and extends radially inwards at right angles thereto is a structural arrangement which provides much greater control over variations from nominal value in the size of the auxiliary gap than was possible with the structural arrangements of previous ring armature transducers such as the "U3" receiver. Moreover, the reduction in size of the mentioned axial gap between pole piece 20 and the nearest point of the diaphragm makes the magnetic structure of the transducer more compact and reduces its reluctance and eddy current losses.

In the manufacture of the described transducer, the lower pole piece 35 is inserted into a mold cavity so as to have its pole face 54 in firm contact with a reference surface within the mold also serving as the mold surface forming the end face 43 of the armature support 40. Accordingly, when synthetic resinous material is injected into the mold to produce the unitary structure consisting of the armature support 40, pole piece 35 and terminal plate 45, such end face 43 will be accurately positioned radially and axially in relation to pole piece 54 so as to facilitate the attainment of a size for the main gap 52 of a desired value. Once such unitary structure has been formed, the magnet 15 is slipped over the cylindrical upstanding sleeve 41 of the armature support to surround it with a close fit and to rest on the radially salient flange 36 of the lower pole piece. Since both the top and bottom surfaces of the magnet are ground, the vertical length of the magnet between these surfaces can be and is controlled to be within close tolerances from nominal value which are prescribed for such length. This means that the vertical distance between lower pole face 54 and the top surface of magnet 15 (or, alternatively the vertical distance between such lower pole face 54 and upper pole face 53) can also be controlled to within close tolerance limits as affected only by tolerance variations in the vertical distance between pole piece 54 and the top surface of flange 36 on which the magnet rests. Further, even such tolerance variations can be minimized if desired by grinding pole face 54 of lower pole piece 35 to be precisely referenced in vertical displacement from the upper surface of the outer margin of flange 36 of that pole piece prior to the time it is inserted into the mold cavity. Accordingly the combining of the described unitary structure of elements 35, 40 and 45 with a magnet 15 of precisely controlled vertical length is another feature permitting the size of the auxiliary gap 51 to be accurately controlled.

As a result of the improved construction of transducer 10 which has been described above, it has been experimentally found that, although such transducer has a single magnet double gap magnetic circuit as compared to the double magnet double gap magnetic circuit of the aforementioned commercial U-3 ring armature receiver, transducer 10 provides a 1 db. improvement at 1000 Hz in motor efficiency over such U-3 receiver according to tests made with a 49 millivolt variable frequency a.c. test signal from a test source having a 150 ohm impedance matching that of both receivers. Much of this improvement can be attributed to the fact that the transducer's geometry permit its manufacture to within close tolerances.

Figure 4:
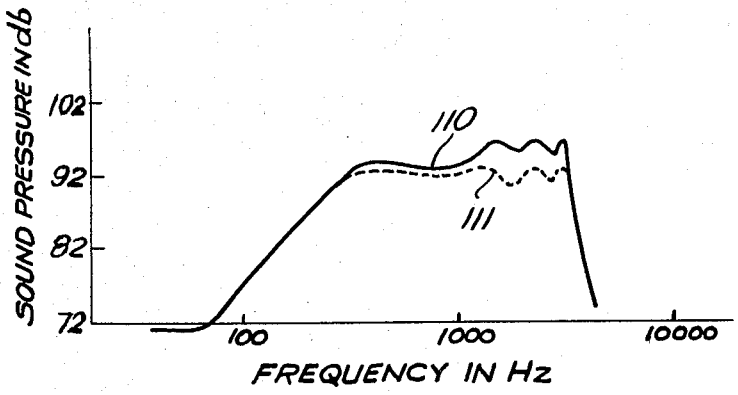
FIG. 4 is a graph showing the sound pressure output level versus frequency characteristic of a ring armature transducer according to an aspect of the invention as compared to that of a transducer now commercially used.

FIG. 4 is a graph showing the improvement just mentioned. In the FIG. 4 graph, the horizontal ordinate represents frequency in Hertz on a logarithmic scale, and the vertical ordinate represents the sound pressure output level in db of a transducer, the vertical scale starting at 72 db. The line 110 represents the output level of a transducer according to the invention (such as transducer 10) as a function of the frequency of the mentioned test signal as such frequency is varied. The line 111 represents the output level vs. frequency characteristic of the mentioned commercial U-3 receiver obtained with the same test signal. FIG. 4 shows that, at 1000 Hz, the tested transducer according to the invention had an output level of 73.5 db which is 1 db greater than the 72.5 db level obtained at that frequency for the U-3 receiver. For the frequency range from about 400 Hz to 1000 Hz the transducer according to the invention had a slightly greater output level than the U-3 receiver, and for the range from 1000 Hz to 3000 Hz, the transducer according to the invention had an output level which exceeded by more than one db the output level of the U-3 receiver, the improvement in output level being particularly pronounced in the range from 1500 Hz to 3000 Hz. The tests on which the FIG. 4 graph is based indicate that a transducer of the construction exemplified by transducer 10 is capable of giving better performance in terms of its output level vs. frequency characteristic than the U-3 transducer now used commercially even though the former transducer has only a single magnet double gap magnetic circuit, whereas the latter transducer has a double magnet double gap magnetic circuit which in theory should be more efficient.

DETAILS OF CONSTRUCTION

Some details (not already disclosed) of the construction of transducer 10 are as follows. The diaphragm 60 is made of aluminum and has a thickness of about 0.002". The upper pole piece 20 may be constructed of either 45 Permalloy (an alloy consisting in weight percent of 45% nickel, 0.5% cobalt, 0.5% manganese, balance ir) or of an Fe-Al alloy of which the preferred composition is, in weight percent, 1%–3% aluminum, balance iron, but which may have any composition accordance with the disclosure of the aforementioned Bordelon et al. U.S. Pat. No. 4,258,324 of Fe-Al alloy compositions for use as the materials for pole pieces in ring armature transducers. The armature support 40 and terminal plate 45 may be constituted of the synthetic resinous material known commercially as "ABS" (acrylonitrile-butadience styrene) or of the synthetic resinous material known commercially as "PPS" (polyphenylene sulfide).

Some dimensions in addition to those previously given are: outer diameter of the permanent magnet 15, 1.8"; vertical length of magnet 15, 0.320±0.004"; height of armature support 40, 0.2925±0.002".

The above described embodiment being exemplary only, additions thereto, omissions therefrom and modifications thereof can be made without departing from the sprit of the invention. Accordingly, the invention is not to be considered as limited save as is indicated by the scope of the following claims.

What is claimed is:

1. A ring armature electroacoustic transducer comprising elements coaxial about a common vertical axis and as follows:

(a) a cylindrical ring magnet with an annular horizontally planar, flat ground upper end face, the material of said magnet comprising an alloy at least 90 percent by weight of which consists of Fe, Cr and Co, with the Cr and Co being present in such 90 percent amount in the respective ranges of 20–40 weight percent of such amount for the Cr and 3–30 weight percent of such amount for the Co, (b) an upper pole piece in the form of an annular disc with a horizontally planar underside which is ground flat at least at its outer margin, said pole piece being seated at its outer margin on said magnet's upper end face so that the respective ground surfaces thereof are in flat abutting relation over the entire area of said upper end face, and so that said pole piece's underside is normal to the inner wall of said magnet, (c) a lower pole piece of "L" cross section to one side of said axis in planes therethrough, said lower pole piece having as integral parts thereof (i) a lower radially salient flange contacting at its outer margin the bottom of said magnet, and (ii) an upper annular stem providing by its upper end a lower pole tip spaced vertically downward from the inner margin of said upper pole piece, (d) a synthetic resinous cylindrical ring armature support disposed with a close fit within said magnet's inner wall and having an upper annular end positioned above said lower pole tip and below said underside of said upper pole piece, (e) an electrical coil disposed radially between said support and said stem to encircle the latter, (f) an armature in the form of a mechanically resilient thin annular disc having to one side of said axis in planes therethrough an elongated rectangular cross section with a downward slant in the radially inward direction, said armature being seated at its outer margin on said upper end of support, and said armature having its inner margin interposed between said two pole pieces to be separated from the lower and upper thereof by, respectively a main air gap and an auxiliary air gap, the outer periphery of said armature being separated from the inner wall of said magnet by a small radial air gap, and (g) an acoustic diaphragm bonded to the top of said armature and separated at its outer margin from said underside of said upper pole piece solely by an axial air gap.

2. A transducer accourding to claim 1 in which the material of said magnet is magnetically anisotropic material.

3. A transducer according to claim 1 in which the upper pole piece on its top side and at its outer margin has a frustroconical face extending radially outward at a downward slant from the top surface of said piece to a termination at the outer diameter of said pole piece adjacent to its bottom surface said face having an inclination to said axis in planes therethrough in the range between about 60° and about 40°.

4. A transducer according to claim 1 in which said upper and lower pole pieces terminate on opposite sides of the inner margin of said armature in respective frustroconical faces providing pole faces of which each has to one side of said axis in planes therethrough a radially inward downward slant substantially the same as that of the adjacent cross section of said armature when unflexed.

5. A transducer according to claim 1 in which said cylindrical ring armature support terminates at its upper end in an annular end face intersecting at a circular edge with the inner cylindrical wall of such support, and in which said armature is seated radially inward of its outer diameter on said edge in substantially circular line contact therewith when said armature is radially centered in relation to said support, said armature and diaphragm having annular portions radially outward of such edge which are supported in cantilevered relation by the portions of said armature and diaphragm radially inward of said edge so that said cantilevered portions are raised above said end face of said support.

6. A transducer according to claim 1 which further comprises a synthetic resinous terminal plate said plate is constituted of the same synthetic resinous material as said armature support, and in which said flange of said lower pole piece has axial apertures therein, said support has at its bottom a radially inturned flange overlying said pole piece flange portion and said apertures therein, said plate underlies the latter flange and said apertures therein, and said flange of said support is joined to said plate by necks of said synthetic resinous material which pass through said apertures such that said support and plate are integral with each other, and said lower pole piece is inseparable from and fixedly secured to a synthetic resinous member comprising said plate and support so as to form a unitary structure with said member.

7. A transducer according to claim 1 in which, when the armature is unflexed, the size of the main gap is no less than about 0.007 inch, and the size of the auxiliary gap is measured between the upper pole tip and the diaphragm is from about 1 to about 3 times the size of the main gap.

8. A transducer according to claim 1 in which the minimum size of said axial air gap between said diaphragm at its outer margin and the underside of said upper pole piece is, when said armature is unflexed, less than the size of said main air gap between the inner margin of said armature and said lower pole tip.

9. A ring armature electroacoustic transducer according to claim 1 further comprising an annular boss integral with said upper pole piece and projecting downward from the inner margin thereof to provide an upper pole tip having an annular lower end face providing an upper pole face above the inner margin of said armature, said boss having a side wall conforming substantially to a surface of revolution about said axis and making an angle therewith, in the downward direction, in planes through said axis, which is less than that made by the underside of said upper pole piece immediately surrounding said boss.

10. A ring armature electroacoustic transducer comprising elements coaxial about a common vertical axis and as follows: an annular magnetic structure of upside-down "L" cross-section to one side of said axis in planes therethrough so as to have a cylindrical ring portion and an annular disc portion, at least part of said ring portion being a permanent magnet, an annular pole piece providing a lower annular pole tip and magnetically coupling said pole tip to the bottom of said structure, said pole tip being vertically spaced downwards from the inner margin of said disc portion, and an armature in the form of a thin annular disc disposed below and lying generally parallel to said disc portion, said armature at its outer margin being magnetically coupled to said magnet above said coupling of said pole piece therewith and, at its inner margin, being interposed between said lower pole tip and said inner margin of said disc portion in spaced relation from each, said transducer having an annular boss integral with said disc portion and projecting downward at the inner margin thereof to provide above the inner margin of said armature an upper pole tip having a lower annular end face providing an upper hole face, said boss having a side wall substantially conforming to a surface of revolution about said axis and making an angle therewith, in the downward direction, in planes through said axis is less than that made by the underside of said disc portion immediately surrounding said boss.

11. A ring armature electroacoustic transducer comprising elements coaxial about a common vertical axis and as follows: an annular magnetic structure of upside-down "L" cross-section to one side of said axis in planes therethrough so as to have a cylindrical ring portion and an annular disc portion, at least part of said ring portion being a permanent magnet, and annular pole piece providing a lower annular pole tip and magnetically coupling said pole tip to the bottom of said structure, said pole tip being vertically spaced downwards from the inner margin of said disc portion, and an armature in the form of a thin annular disc disposed below and lying generally parallel to said disc portion, said armature at its outer margin being magnetically coupled to said magnet above said coupling of said pole piece therwith and, at its inner margin, being interposed between said lower pole tip and said inner margin of said disc portion in spaced relation from each, said transducer having a frustroconical face disposed at the radially outer margin of said disc portion and extending from the top surface of said disc portion radially outward with a downward slant to a termination at the outer diameter of said disc portion and adjacent to the bottom surface thereof, said frustroconical face being at an angle to said axis in planes therethrough which lies in the range between about 60 degrees and 50 degrees.

* * * * *